US005533434A

United States Patent [19]

Begneu

[11] Patent Number: 5,533,434

[45] Date of Patent: Jul. 9, 1996

[54] METHOD AND SYSTEM FOR SUPPLYING A DEVICE WITH A VOLUME OF HYDRAULIC FLUID WHOSE PREDETERMINED VALUE ACCORDING TO OPERATING CONDITIONS

[75] Inventor: Michel Begneu, Bourges, France

[73] Assignee: Giat Industries, Versailles, France

[21] Appl. No.: 256,227

[22] PCT Filed: Oct. 29, 1993

[86] PCT No.: PCT/FR93/01071

§ 371 Date: Sep. 12, 1994

§ 102(e) Date: Sep. 12, 1994

[87] PCT Pub. No.: WO94/10522

PCT Pub. Date: May 11, 1994

[30] Foreign Application Priority Data

Nov. 2, 1992 [FR] France ..... 92 13100

[51] Int. Cl.[6] ..... F41A 1/04

[52] U.S. Cl. ..... 89/7

[58] Field of Search ..... 89/7, 8; 102/440

[56] References Cited

U.S. PATENT DOCUMENTS

| | | | |
|---|---|---|---|
| 4,050,349 | 9/1977 | Graham | 89/7 |
| 4,281,582 | 8/1981 | Jaqua | 89/7 |
| 4,523,508 | 6/1985 | Mayer et al. | 89/7 |
| 4,745,841 | 5/1988 | Magoon et al. | 89/7 |
| 5,381,722 | 1/1995 | Begneu | 89/7 |

FOREIGN PATENT DOCUMENTS

| | | | |
|---|---|---|---|
| 0250978 | 1/1988 | European Pat. Off. | 89/7 |

*Primary Examiner*—Stephen M. Johnson
*Attorney, Agent, or Firm*—Oliff & Berridge

[57] ABSTRACT

A system for supplying a hydraulic fluid to a device such as a combustion chamber of a barrel of a liquid-propellant weapon containing a hydraulic jack including a piston and a cylinder that define a variable-volume chamber connected to a combustion chamber by an outlet passage. The system has a damper assembly that includes a tip portion that projects inside a variable-volume chamber and a cavity formed in a piston to damp the movement of the piston at the end of its travel by a hydraulic fluid compression effect. An adjustment mechanism allows the length of tip projecting inside the chamber to be adjusted according to the volume of the variable-volume chamber.

9 Claims, 2 Drawing Sheets

METHOD AND SYSTEM FOR SUPPLYING A DEVICE WITH A VOLUME OF HYDRAULIC FLUID WHOSE PREDETERMINED VALUE ACCORDING TO OPERATING CONDITIONS

BACKGROUND OF THE INVENTION

The present invention relates to a system for supplying a device with a volume of hydraulic fluid whose predetermined value varies according to operating conditions. The system includes a hydraulic jack comprising a piston and a cylinder that, together with the piston, define a variable-volume chamber connected to the device. The system also includes structure for supplying the chamber with pressurized fluid, structure for controlling the travel of the piston that may include introducing pressurized fluid into the cylinder on the side opposite the chamber, and structure for damping the movement of the piston at the end of its travel.

In general, in a supply system of the aforesaid type, the damping structure, for example, be of the hydraulic compression effect type or the servo type.

For damping by the hydraulic compression effect, the end of the jack cylinder may have a cavity designed to receive a projection of a corresponding shape provided on the piston. The jack, equipped with such damping structure, is designed for specific operating conditions. In other words, the jack is chosen as a function of the feed conditions necessary to the operation of the device. If these conditions are changed, particularly the speed of the piston at the end of its travel, the jack must be replaced by a jack whose characteristics are matched to the new conditions, which may entail assembly/disassembly operations that are often lengthy and tedious.

Servo damping by controlling the flowrate of the fluid supplied to the jack requires an apparatus comprising particular pressure and position sensors that deliver signals that are subsequently processed by a computer to regulate the fluid flowrate as the piston moves. Such apparatus is complex, expensive, and difficult to develop.

SUMMARY OF THE INVENTION

An object of the invention is to design a supply system of the aforesaid type wherein the piston end-of-travel damping structure is designed to take into account operating conditions that can be modified, which modifications do not entail replacement of the jack and/or the damping structure, the latter being designed for variable speeds attained by the piston at the end of its travel.

In order to achieve this and other objects, the invention in one aspect proposes a supply system of the type that includes a piston having a variable speed at the end of its travel, the speed being determined by the initial axial length of the chamber of a jack. The piston end-of-travel damping means includes a rod mounted on a cylinder end that projects inside the chamber and a cavity of a corresponding shape and size formed on the piston that is designed to receive the piston end-of-travel rod to brake and damp the movement of the piston by a hydraulic compression effect. Means are also provided to regulate the length of the rod projecting into the chamber as a function of the speed attained by the piston at the end of travel.

According to another aspect of the invention, the jack cylinder end in the direction in which the piston moves is axially movable to adjust the initial volume of the chamber, and the means regulating the length of the rod of the damping means projecting inside the chamber also adjusts the position of the end of the cylinder.

According to another aspect of the invention, the aforesaid adjusting means simultaneously ensures movement of the rod of the damping means and the cylinder end so that the rod of the damping means projects inside the chamber over a length that increases with a decrease in volume of the chamber.

According to yet another aspect of the invention, there is provided a hydraulic fluid system comprising a hydraulic jack comprised of piston and a cylinder that together define a variable volume chamber, a fluid supply connectable with the chamber for supplying the chamber with pressurized fluid so as to control the movement of the piston, and a damper assembly, coupled to said piston, for damping movement of the piston at the end of its travel, wherein the speed of the piston at the end of travel is variable and determined by an initial axial length of the chamber, the damper assembly comprises a tip mounted on a cylinder end that projects inside the chamber and a cavity of a corresponding shape and size formed on the piston and designed to receive the tip to brake and damp the movement of the piston by a hydraulic compression effect, and the supply system further comprises an adjustment mechanism for regulating the length of the tip projecting into the chamber as a function of the speed obtained by the piston at the end of travel.

According to still another aspect of the invention, there is provided a method for supplying a device with a hydraulic fluid that varies according to device operating conditions, the device being supplied with the fluid by a supply system that includes a piston and a cylinder that together define a variable volume chamber, the supply system also including a damper assembly that includes a tip mounted on a cylinder, the method including the steps of supplying the chamber with pressurized fluid; controlling movement of the piston with the pressurized fluid; damping the movement of the piston at the end of its travel; and regulating the length of the tip projecting into the chamber as a function of the speed obtained by the piston.

According to one embodiment of the invention, the cylinder end is constituted by a cylindrical element screwed into the jack body, the rod of the damping means is screwed inside the tubular element with threads that are finer than those used for screwing the cylindrical element into the jack body, means are provided to immobilize the rod rotationally, and the adjusting means includes a device controlling the rotation of the cylinder end.

Thus, according to this embodiment, the adjusting means moves the rod of the damping means and the cylinder end in the same direction, but over different displacement lengths, by a single control means.

As an alternative, the adjusting means can be designed to move the rod of the damping means and the cylinder end in two opposite directions.

Thus, a supply system according to the invention can easily be adapted to operating conditions that can vary from one application to another without requiring a complex, difficult-to-adjust apparatus.

Such a supply system can for example be used in a liquid-propellant weapon for injecting a predetermined quantity of a propellant under pressure into the combustion chamber of the weapon barrel.

In such an application, the propellant is stored in a variable-volume reservoir that is formed as a part of the chamber of the hydraulic jack in which a pressure-multiplying piston moves, driven by the pressure of the gases prevailing inside the combustion chamber, which pressure is then insufficient to cause the projectile loaded in the weapon barrel to be ejected. In view of the acceleration imparted to the piston due to a rapid pressure rise of the combustion gases, the speed reached by the piston at the end of its travel is relatively high, and it is desirable to provide damping means to brake the movement of the piston at the end of its travel.

In such a supply system, it is advantageous to provide a variable-volume reservoir as a function of the desired firing conditions, but in this case a change in the volume of the chamber will involve a change in the speed reached by the piston at the end of its travel.

Thus, a supply system according to the invention is fully adapted to taking different firing conditions into account, a possibility that cannot be achieved with a fixed-volume reservoir.

BRIEF DESCRIPTION OF THE DRAWINGS

Other advantages, characteristics, and details of the invention will emerge from the explanatory description given hereinbelow with reference to the attached drawings provided only as an example, wherein.

DETAILED DESCRIPTION OF PREFERRED EMBODIMENTS

Figure 1:
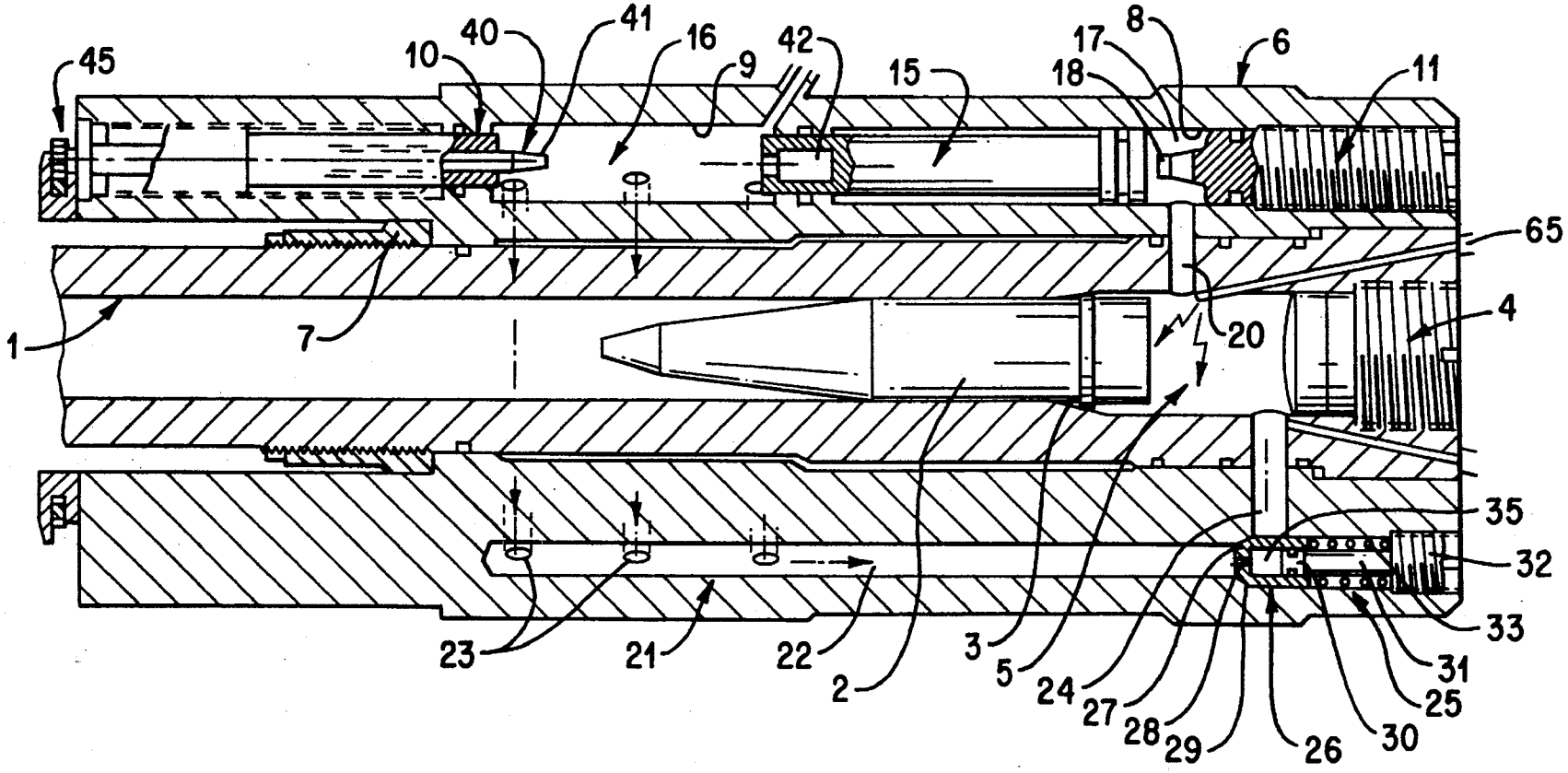
FIG. 1 is a partial schematic cross section of a liquid-propellant weapon equipped with a supply system according to the invention.
Figure 3:
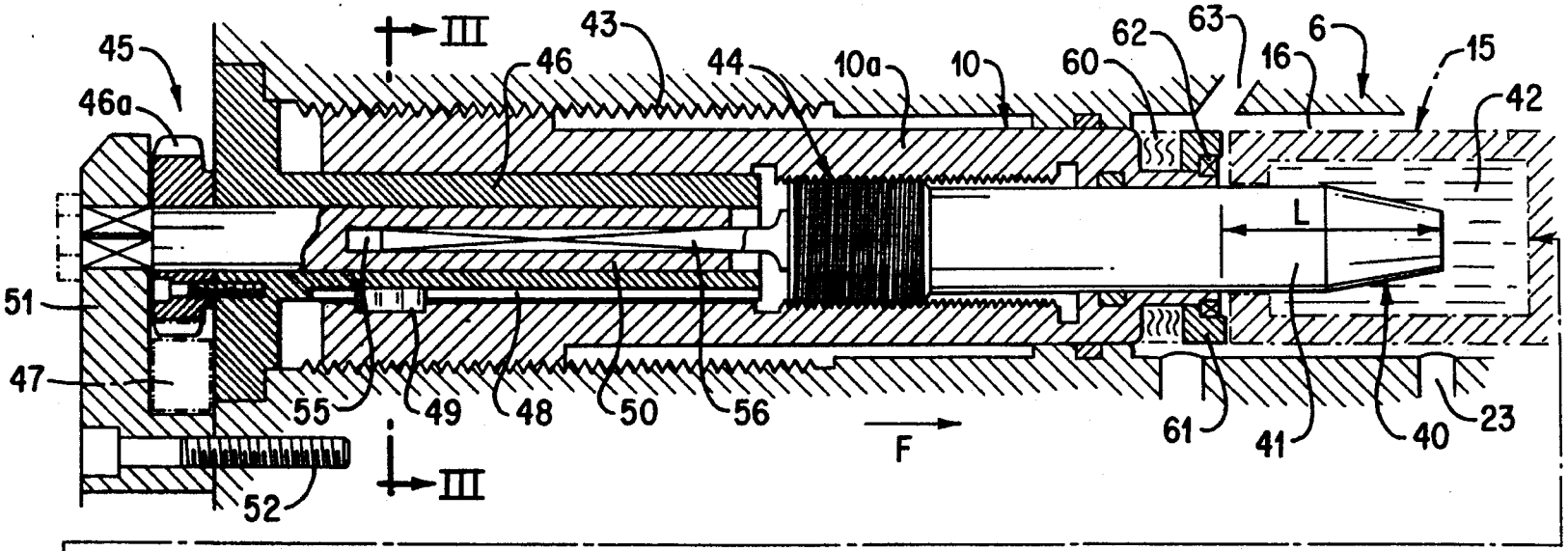
FIG. 3 is a partial cross section along line III—III in FIG. 2.
Figure 3:
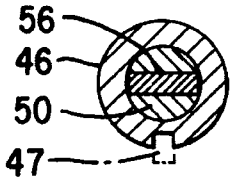

FIG. 1 shows schematically the barrel 1 of a medium or large caliber liquid-propellant weapon with a projectile 2 loaded in the barrel 1 at the level of a forcing cone 3, which is achieved in a known manner. The rear of barrel 1 is sealably closable by a breechblock 4. A combustion chamber 5 is delimited in barrel 1 between projectile 2 and breechblock 4 when the latter is in the closed position.

The liquid-propellant weapon is equipped with an injection system according to the invention to inject, under pressure, into chamber 5, a given quantity of a propellant such as a liquid or gelled fuel.

The injection system is accommodated in a body 6 enclosing barrel 1 and attached thereto by a nut 7, for example. A lengthwise duct 8 is provided in body 6, parallel to the axis of barrel 1, and a cylinder 9 is defined between two ends 10 and 11 inside the duct 8. Each of the two ends 10 and 11 includes a cylindrical element whose axial position is adjustable inside duct 8 and that sealably closes off one end thereof, and a plug that sealably closes off the other end of the duct 8.

A pressure-multiplying piston 15 is slidably mounted inside cylinder 9. A variable-volume chamber 16 is delimited between piston 15 and end 10 of cylinder 9. A second variable-volume chamber 17 is delimited between piston 15 and the other end 11 of cylinder 9. An axial stop 18 integral with end 11 projects inside second chamber 17, against which stop piston 15 rests when chamber 16 contains the quantity of propellant necessary to fire projectile 2.

An inlet passage 20 provides communication between the second chamber 17 of the cylinder 9 and the combustion chamber 5. The inlet passage 20 may be in the form of a radial duct provided in body 6 and the wall of barrel 1.

An outlet passage 21 provides communication between the first chamber 16 of cylinder 9 and the combustion chamber 5. The outlet passage 21 includes a second blind lengthwise duct 22 provided in the body 6 that is parallel to the first duct 8, connecting ducts 23 each of which has a first end that terminates in chamber 16 and a second end that terminates in the second duct 22, and a radial duct 24 has a first end that terminates in the combustion chamber 5 and a second end that is communicable with the second duct 22.

A pressure-actuated valve 25 is mounted in the connecting section between the two ducts 22 and 24 of outlet passage 21. Valve 25 has a plug 26 formed of a tubular element of which one end face or front face is closed by an end wall 27 provided with a central aperture 28. Plug 26 is slidably and sealably mounted in second lengthwise duct 22, being introduced thereinto by its front face so that its end wall 27 can rest on an annular seat 29 machined into body 6 around the end of the second duct 22 that terminates in radial duct 24.

A piston 30, centered and slidably and sealably mounted inside plug 26, rests on the end of a rod 31 that extends to a plug 32 that nonsealably closes the open end of the second duct 22 that terminates in the rear face of body 6. A return spring 33 wrapped around rod 31 urges plug 26 onto its seat 29 in order to close the duct section between second duct 22 and radial duct 24 of outlet passage 21.

It should be noted that a chamber 35 is delimited inside the plug 26 between the end wall 27 and the piston 30 when the valve 25 is closed. The chamber 35 communicates with the duct 22 by an aperture 28 in an end wall 27 of the plug 26. This being the case, the return force of the spring 33 for keeping the valve 25 closed need only be greater than the difference in the forces exerted by the propellant contained in duct 22 and in chamber 35, on the two opposite faces of the end wall 27 of the plug.

Damping means 40 is accommodated inside cylinder 9 in the vicinity of cylinder end 10 to damp and brake the movement of piston 15 at the end of its travel.

Figure 2:
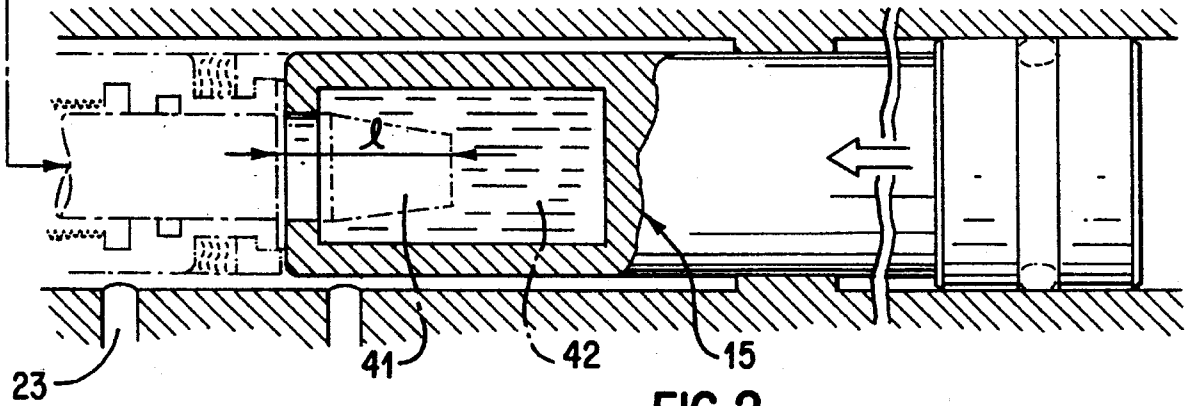
FIG. 2 is a schematic cross section showing the details of one embodiment of the supply system according to the invention.

With reference to FIGS. 1 and 2, the damping means 40 comprises a rod or tip 41 borne on the cylinder end 10 and projecting inside the chamber 16, and a cavity 42 of a corresponding shape and size formed on the piston 15 and designed to receive the tip 41 at the end of the travel of the piston 15. Adjusting means 45 is provided to regulate the length of the tip 41 projecting inside the chamber 16 as a function of the speed attained by the piston 15 at the end of its travel, which means will be described in detail with reference to the embodiment illustrated in FIG. 2.

The cylinder end 10 includes a tubular element **10*a* that is screwed into duct 8, the corresponding threads being referenced as 43. The tip 41 is screwed inside the tubular element 10*a*, the corresponding threads being referenced as 44, these threads being finer than threads 43. A sleeve 46 is accommodated inside the tubular element 10*a* and extends over a length less than that of the latter. This sleeve 46 partly projects outside the duct 8, and it is joined to a pinion 46*a* driven rotationally by a crown 47, itself driven rotationally by a drive element (not shown). Tubular element 10*a* is rotationally joined to the sleeve 46 by a key 49 that freely engages a lengthwise groove 48 extending along the outer wall of sleeve 46. A tube 50 is mounted inside sleeve 46 with an end that rotationally supports pinion 46*a* and that is attached to a plate 51 joined to body 6 by bolts 52, for example. At the other end, tube 50 has an axial aperture 55 with a rectangular cross section in which a rod 56 of a corresponding cross-section is slidably mounted, and which is integral with tip 41**.

Thus, adjusting means 45 ensures at the same time the axial positioning of cylinder end 10 to vary the volume of chamber 16 of cylinder 9, and ensures displacement of tip 41 inside chamber 16 to regulate its length projecting into chamber 16.

Cylinder end 10 has a reduction in diameter at the end at which tip 41 projects. This reduction in diameter allows accommodation of at least one damping ring 60 at the end of travel on which ring a sleeve 61 forming a stop and retained by a nut 62 rests.

Chamber 16 of cylinder 9 is supplied with propellant through a duct 63 that terminates in chamber 16. The duct 63 is connected to a reservoir (not shown) with interposition of a check valve.

The operation of the supply system described above will now be described.

Before projectile 2 loaded in barrel 1 is fired, the volume of chamber 16 forming a reservoir is adjusted so that the total quantity of propellant necessary for firing projectile 2 can be stored there. This operation includes adjusting the axial position of cylinder end 10 by activating adjusting means 45 that also adjusts the length of tip 41 projecting inside chamber 16.

Once these adjustments have been made, the propellant is sent at low pressure into chamber 16 through inlet duct 63. The propellant expands in chamber 16 and in outlet passage 21. The pressure of the propellant is sufficient to cause piston 15 to recoil in the direction of stop 18 but it is insufficient to cause valve 25 to open, the plug 26 of the valve resting on its seat 29 to prevent the propellant from reaching combustion chamber 5. A small quantity of propellant is then injected directly into combustion chamber 5 via rear inlet 65, and ignited. The combustion gases penetrate the second chamber 17 of cylinder 9 by inlet passage 20. The pressure of these gases is insufficient to eject projectile 2, but is sufficient to move piston 15 inside cylinder 9. As it moves, piston 15 compresses the propellant contained in chamber 16 and outlet passage 21. As soon as this pressure reaches a sufficient level to open valve 25, the propellant under pressure is injected into combustion chamber 5. The pressure applied to piston 15 increases rapidly, so that piston 15 reaches a relatively high speed by the end of its travel. Damping means 40 then goes into action, and piston 15 is braked by a compression effect of the propellant contained in cavity 42 of the piston when tip 41 engages this cavity 42. The residual energy of piston 15 is then absorbed by damping rings 60 when piston 15 comes in contact with sleeve 61. The pressure of the gases inside combustion chamber 5 has then become sufficient to eject projectile 2. In general, the ejection of projectile 2 occurs before piston 15 reaches its end-of-travel position, to maintain combustion as long as projectile 2 is inside barrel 1.

Assume that it is desired to modify the firing conditions of a new projectile 2 loaded in barrel 1 of the weapon to achieve for example a decrease in the firing range. This can be accomplished with a decrease in the quantity of propellant to be injected into combustion chamber 5. Hence the volume of chamber 16 must be decreased by moving cylinder end 10 in the direction of arrow F (FIG. 2). To do this, adjusting means 45 is activated, i.e. pinion 46 is driven rotationally in the desired direction to decrease the volume of chamber 16. Rotation of sleeve 46 causes rotation of cylinder end 10 which, by threads 43, moves axially according to arrow F inside cylinder 9. At the same time, tip 41, by means of threads 44 by which it is screwed into cylinder end 10 and by means of rod 56 that immobilizes it rotationally, moves axially in the same direction F inside chamber 16 of cylinder 9, but over a smaller travel distance than that of cylinder end 10.

Thus, the decrease in volume of chamber 16 brings about a decrease in the length of tip 41 projecting inside chamber 16 from a value L to a smaller value 1 (FIG. 2). In fact, as the volume of chamber 16 decreases, the speed of piston 15 at the end of its travel will be slower, causing less of a hydraulic compression effect to damp and brake piston 15. In other words, tip 41 will project into cavity 42 of piston 15 by a lesser length. Conversely, in the case of an increase in the volume of chamber 16 with a higher end-of-travel speed of piston 15, tip 41 will project inside chamber 16 by a greater length.

In such a liquid-propellant weapon, it is advantageous to provide several cylinders 8 each chamber 16 of which communicates with outlet passage 21 that carries the propellant to combustion chamber 5.

Of course, the invention is not limited to the above embodiment which was provided only as an example. In particular, at least one variant could be conceived relating to adjusting means 45, which can be designed to move the cylinder end and the tip in opposite directions. In addition, the tip and the cylinder end may be independently adjusted using separate adjustments. Finally, the application of the invention is not confined to a system for supplying the combustion chamber of a liquid-propellant weapon, but has application to any system in which the operating conditions require delivery of a volume of hydraulic fluid with a predetermined, variable value.

What is claimed is:

1. A system for supplying a device with a volume of hydraulic fluid having a predetermined value that is variable according to operating conditions, the system having a hydraulic jack comprised of a piston and a cylinder that define a variable-volume chamber connected to the device, means for supplying the chamber with fluid under pressure, means for controlling the movement of the piston, and means for damping the movement of the piston at the end of its travel, wherein the speed of the piston at the end of travel is variable and determined by an initial axial length of said chamber, the piston end-of-travel damping means comprises a tip mounted on a cylinder end of the cylinder that projects inside said chamber and a cavity of a corresponding shape and size formed on the piston and designed to receive the tip to brake and damp the movement of the piston by a hydraulic compression effect, and the system further comprises means for regulating the length of the tip projecting into said cavity as a function of the speed attained by the piston at the end of travel.

2. The supply system according to claim 1, wherein the cylinder end, in the direction in which the piston moves, is axially movable to adjust an initial volume of the chamber, and wherein the regulating means also includes means for adjusting a position of the end of said cylinder.

3. The supply system according to claim 2, wherein the adjusting means simultaneously ensures movement of the tip and the cylinder end so that the length of the tip projecting inside the chamber decreases with an increase in volume of the chamber.

4. The supply system according to claim 3, wherein said adjusting means moves the tip and the cylinder end in the same direction, over different displacement lengths.

5. The supply system according to claim 2, wherein the cylinder end includes a tubular element that includes threads that are screwed into a jack body, the tip of the damping means includes threads that are screwed inside said tubular element, the threads needed for screwing the tip are finer than those used for screwing the cylinder end and the supply system further comprises means for immobilizing said tip rotationally, and wherein the adjusting means includes a device for controlling the rotation of said cylinder end.

6. The supply system according to claim 5, wherein the rotation control device includes a sleeve that is accommodated inside the tubular element that forms the end of the cylinder and is driven rotationally by a pinion and a key that is movable in a groove to link the sleeve and the cylinder end rotationally.

7. The supply system according to claim 6, wherein the means for immobilizing the tip rotationally comprises a fixed tube having a rectangular cross section accommodated in said sleeve in which a rod of matching cross section integral with the tip is slidably mounted.

8. A hydraulic fluid supply system comprising a hydraulic jack comprised of a piston and a cylinder that together define a variable-volume chamber, a fluid supply connectable with the chamber for supplying the chamber with pressurized fluid so as to control movement of the piston, and a damper assembly, coupleable to said piston in a coupled position, for damping movement of the piston at an end of its travel, wherein the speed of the piston at the end of travel is variable and determined by an initial axial length of said chamber, the damper assembly comprises a tip mounted on a cylinder end of said cylinder that projects inside said chamber and a cavity of a corresponding shape and size formed on the piston and designed to receive the tip to brake and damp the movement of the piston when the piston approaches the coupled position, and the supply system further comprises an adjustment mechanism for regulating a length of the tip projecting into said cavity when the piston reaches the coupled position.

9. A method for supplying a device with a hydraulic fluid that varies according to device operating conditions, the device being supplied with said hydraulic fluid by a supply system that includes a piston having a cavity and a cylinder, the piston and the cylinder together defining a variable-volume chamber therebetween, the supply system also including a damper assembly that includes a tip mounted in a cylinder end of the cylinder, said tip protruding into said cavity in a coupled position, said method including:

supplying the chamber with the hydraulic fluid;

controlling movement of the piston with the hydraulic fluid;

damping the movement of the piston as the piston approaches the coupled position; and regulating a length of the tip projecting into said cavity when the piston reaches the coupled position.

* * * * *